United States Patent [19]

Jolkovski

[11] Patent Number: 4,881,726

[45] Date of Patent: Nov. 21, 1989

[54] VISE FOR JOINING FRAMES

[76] Inventor: Robert M. Jolkovski, 34 Hamilton Rd., Arlington, Mass. 02174

[21] Appl. No.: 175,843

[22] Filed: Mar. 31, 1988

[51] Int. Cl.[4] ..... B25B 1/20

[52] U.S. Cl. ..... 269/41; 269/60; 269/71; 269/164; 269/45

[58] Field of Search ..... 269/37, 45, 41, 43, 269/60, 71, 104, 140, 141, 152–155, 203, 204, 246, 139, 164; 254/10.5

[56] References Cited

U.S. PATENT DOCUMENTS

| | | | |
|---|---|---|---|
| 731,665 | 6/1903 | Clayton | 269/45 |
| 832,087 | 10/1906 | Scoggins | 269/203 |
| 1,120,798 | 12/1914 | Duecker | 269/45 |
| 1,459,094 | 6/1923 | French . | |
| 1,704,893 | 3/1929 | Harrison . | |
| 2,322,380 | 6/1943 | Mosley | 269/164 |
| 2,568,393 | 9/1951 | Helbig | 269/203 |
| 2,679,178 | 5/1954 | Odin | 269/104 |
| 2,680,395 | 6/1954 | Christiansen | 269/164 |
| 2,883,742 | 4/1959 | Prath | 254/10.5 |
| 3,137,492 | 6/1964 | Dussold . | |
| 3,290,039 | 12/1966 | Lancaster | 269/104 |
| 4,023,787 | 5/1977 | Violette . | |
| 4,061,321 | 12/1977 | Farr . | |
| 4,262,515 | 4/1981 | Frei | 254/10.5 |
| 4,317,560 | 3/1982 | Troyer | 269/60 |

FOREIGN PATENT DOCUMENTS

| | | | |
|---|---|---|---|
| 584576 | 1/1947 | United Kingdom | 269/45 |

*Primary Examiner*—Robert C. Watson

*Attorney, Agent, or Firm*—Ira S. Dorman

[57] ABSTRACT

A vise for joining frame pieces has clamp assemblies which can be moved on perpendicular axes, and has a quick-acting shifting mechanism for displacing one of the clamp assemblies from an initial position and returning it thereto. The complementary end faces of mounted frame pieces can thereby be brought into precise abutted registry with one another to establish a corner joint, moved apart by use of the shifting mechanism to permit the application of a fast-setting adhesive to the mating surfaces, and thereafter returned by reverse action of the mechanism to secure them in precisely the same relationship as was initially established.

10 Claims, 4 Drawing Sheets

VISE FOR JOINING FRAMES

BACKGROUND OF THE INVENTION

In making frames for pictures, photographs and the like, it is necessary to maintain the pieces of moulding from which the frame is constructed at a precise angular relationship to one another while the corner joints are secured. Although vises for holding the frame components in correct relationships to one another have previously been provided, in many respects they have not been optimal from the standpoint of ease of use, accuracy, simplicity and/or expense. A particularly disadvantageous feature of such prior art vises is that they are not well suited for use in assembling frames with fast-setting adhesives, since they normally require removal and reclamping of the moulding pieces after proper positioning has been established. Such adhesives inhibit relative movement of the parts after initial contact, and do not therefore readily permit realignment of the joint.

Accordingly, it is the broad object of the present invention to provide a novel vise which is particularly adapted for joining frame pieces, and which is fast and convenient to use, which enables precise alignment of the frame components, and is of relatively simple and inexpensive construction.

A more specific object of the invention is to provide a vise having the foregoing features and advantages, which incorporates a mechanism for separating the workpieces after their ultimate relationship to one another in the frame has been established, and for thereafter returning them to their original position without removing and repositioning them in the clamp, to thereby facilitate gluing operations.

Another specific object of the invention is to provide such a vise wherein the angular attitude of the clamp assemblies can readily be adjusted, so as to adapt the device for making frames having components disposed in nonperpendicular relationships.

It is also an object of the invention to provide a novel method for joining frame pieces, wherein the desired relationship can be established initially and precisely reestablished after the frame pieces are separated from one another, such as to permit the application of an adhesive between their complementary end faces.

SUMMARY OF THE INVENTION

It has now been found that certain of the foregoing and related objects of the invention are readily attained by the provision of a vise for joining frame pieces, comprising a base, first and second clamp assemblies, and means for fixing the assemblies in selected positions. The first clamp assembly includes a first body supported on the base and movable laterally, with respect thereto, along a path on a first rectilinear axis, and the second clamp assembly includes a second body supported on the base laterally adjacent the first body and movable transversely with respect to the base along a path on a second rectilinear axis perpendicular to the first axis. The means for fixing the clamp assemblies serves to position them at any point along their respective paths. Means for clamping a frame piece is provided on both of the bodies, and is adapted to dispose the frame pieces in a common plane so that they can be brought into and maintained in mutual contact, in at least one accurate angular relationship.

Normally, the means for fixing the clamp assemblies will also serve for adjusting their positions along their respective paths, and it will advantageously comprise screws. In the preferred embodiments, the vise will additionally include first and second support pieces disposed on the base and supporting, respectively, the first and second bodies thereon, with each of the means for fixing being operatively connected to one of the support pieces.

The vise will most desirably additionally include a mechanism for laterally shifting the first support piece between predetermined limit positions on the first axis, operating independently of the means for fixing the first clamp assembly. The shifting mechanism will usually comprise a lever that is operative to quickly move the associated support piece from one of the limit positions to the other. The base of the vise will usually have a flat upper surface, upon which plate-like support pieces are slidably mounted. The preferred forms of the device will also employ bodies and support pieces which have cooperating means thereon for varying their relative angular orientations, about a normal axis between them, thereby permitting endabutting contact of mounted frame pieces in a plurality of angular relationships to one another.

Other objects of the invention are attained by the provision of a method for joining frame pieces, in which the above-described vise is employed. In accordance with it, one of the frame pieces to be joined is first mounted in each of the clamp assemblies, with the complementary end faces of the pieces proximate to, but out of contact with, one another. The means for fixing, provided on the vise, are adjusted to bring the frame pieces into an initial relative position with the end faces in direct contact and precise registry with one another, following which the mechanism for shifting is operated to separate the end faces. At least one of the end faces is then acted upon, preparatory to effecting securement of the frame pieces to one another, and the mechanism is reversely operated to return the frame pieces to their initial relative position. Normally, a fast-setting adhesive will be applied as the step that is carried out preparatory to effecting securement of the pieces.

DETAILED DESCRIPTION OF THE ILLUSTRATED EMBODIMENT

Figure 1:
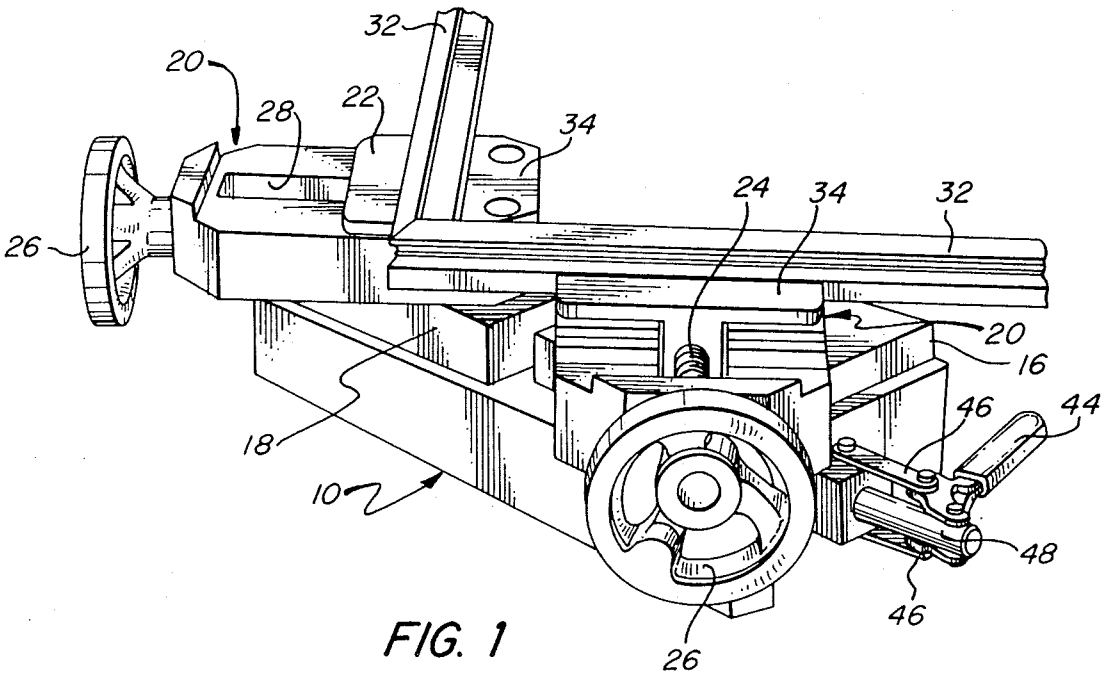
FIG. 1 is a perspective view of a vise embodying the present invention, shown in use to hold frame components (moulding pieces) in a perpendicular, end-abutted relationship to one another.
Figure 2:
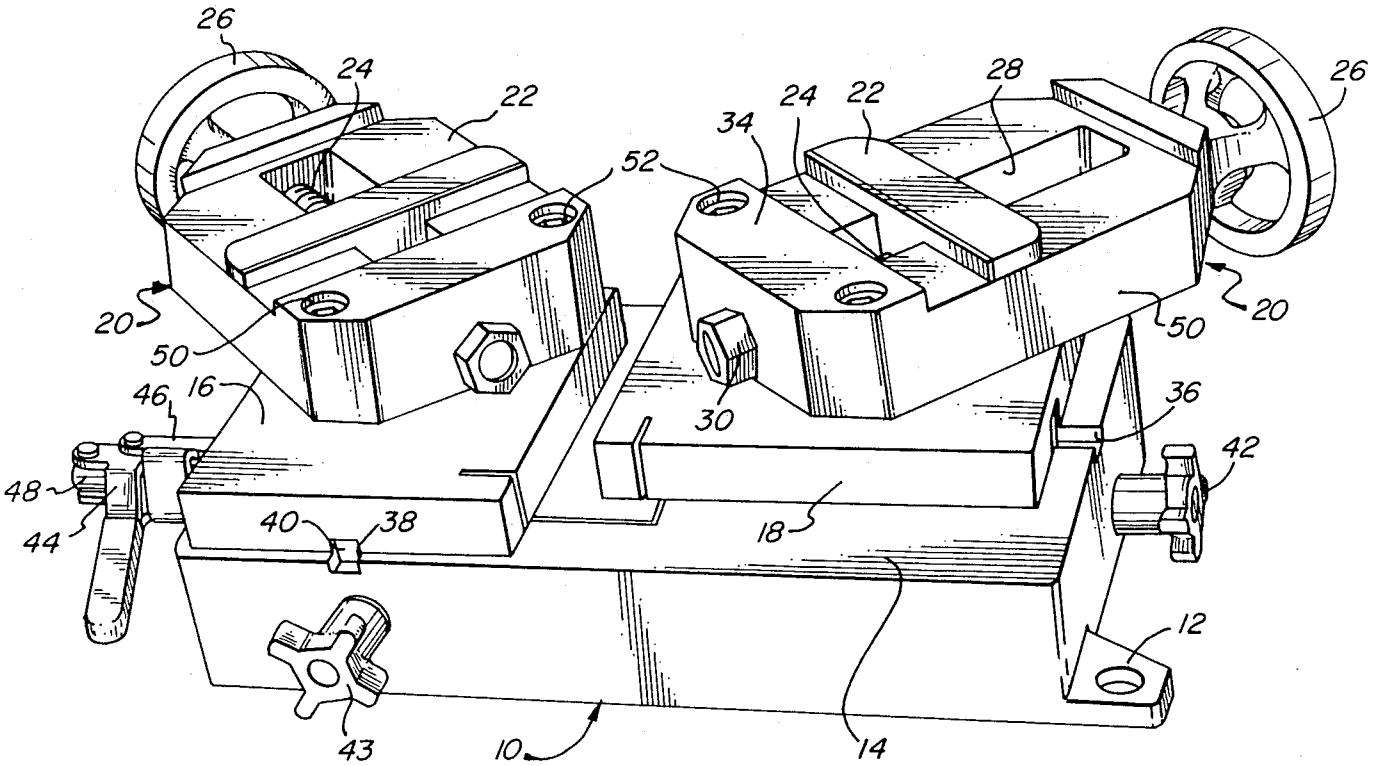
FIG. 2 is a somewhat enlarged perspective view of the vise of FIG. 1 with the frame components removed, taken from the opposite side thereof.

Turning now in detail to the FIGS. 1–5 of the appended drawings, therein illustrated is a vise embodying the present invention and including a rectangular base, generally designated by the numeral 10, having mounting lugs 12 (only one of which is visible) projecting laterally from the bottom thereof. As will be appreciated, the base 10 will normally be fabricated from a heavy metal (e.g., cast iron) to provide stability on a supporting surface, with the lugs 12 permitting semipermanent attachment, if so desired.

The base 10 has a flat and smooth upper surface 14, on which is slidably supported a pair of rectangular support plates 16, 18. Each plate in turn supports a clamp assembly consisting of a body, generally designated by the numeral 20, a movable jaw 22, a screw 24 and an operating wheel 26. The screw 24 is attached at one end to the wheel 26, and extends through an aperture in the rear wall of the associated body and along a channel 28 formed thereinto; it is secured by a nut 30 at its opposite end. The movable jaw 22 has a part (not visible) that projects into the channel 28, which has a threaded aperture in which the screw 24 is engaged. Accordingly, rotation of the wheel 26 will bring the jaw 22 into firm engagement upon the frame component 32, in cooperation with the elevated shoulder portion 34 at the front of the body 20; such a mechanism is of course entirely conventional.

A pair of shallow rectilinear channels 36, 38 are milled, on mutually perpendicular axes, into the upper surface 14 of the base 10. Each receives a key 40 projecting downwardly thereinto from, and beyond the bottom surface of, the overlying support plate 16, 18, which thereby serves to constrain the plates to slidable movement along perpendicular axes. Screws 42, 43, having operating knobs on their outer ends, engage threaded openings through elements (not visible in these Figures) depending into the base 10 from the plates 18, 16, respectively, and thereby serve to position the plates along the rectilinear axes defined by the channels 36 and 38. For this purpose the screw 43 associated with plate 16 is merely rotatably mounted (in a fixed axial position) through a wall of the base; the screw 42, for plate 18, passes loosely through an aperture in the adjacent wall, and is associated with other parts in a manner to be described. As will be appreciated, the screws not only permit fine adjustment of the positions of the slide plates 16, 18 (and hence of the clamping assemblies mounted thereon), but they also function to maintain them in the selected positions.

A quick-acting shifting mechanism includes a lever handle 44 pivotably mounted to the base 10 by a pair of links 46. A connecting rod 48 is in turn pivotably attached to the handle 44 at one end, and is operatively connected to the slide plate 18 at the opposite end thereof. Movement of the handle 44 will cause the rod 48 to extend and retract laterally within the base 10, thereby shifting the plate 18 and the clamping assembly mounted thereupon.

Figure 3:
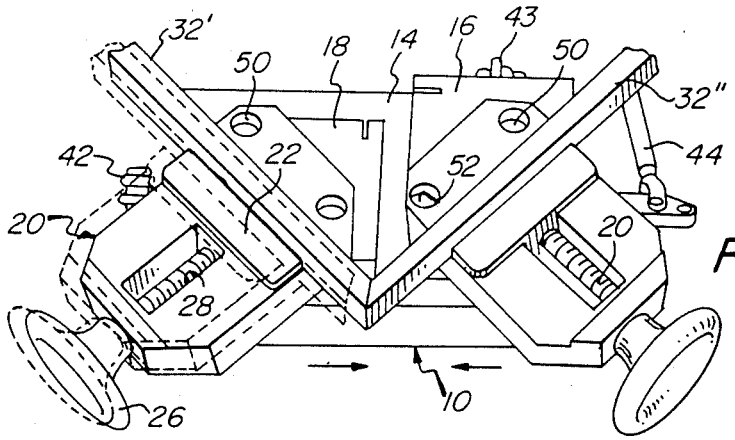
FIGS. 3–5 are diagrammatic perspective views of the vise with frame components clamped therein, drawn to a diminished scale and depicting the sequence of movements that would typically be employed in use of the vise for constructing a picture frame corner joint.
Figure 4:
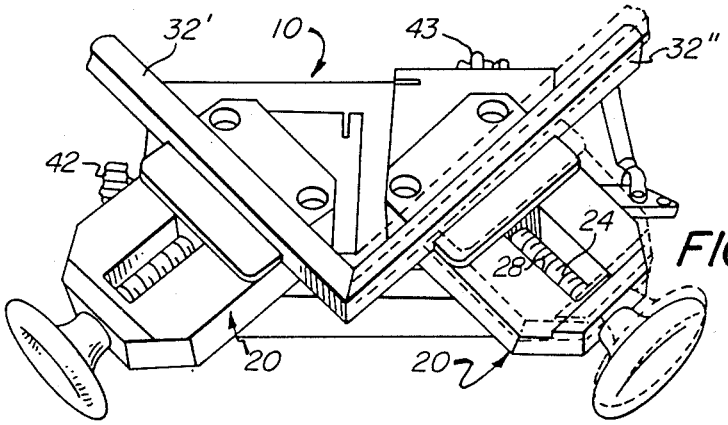
Figure 5:
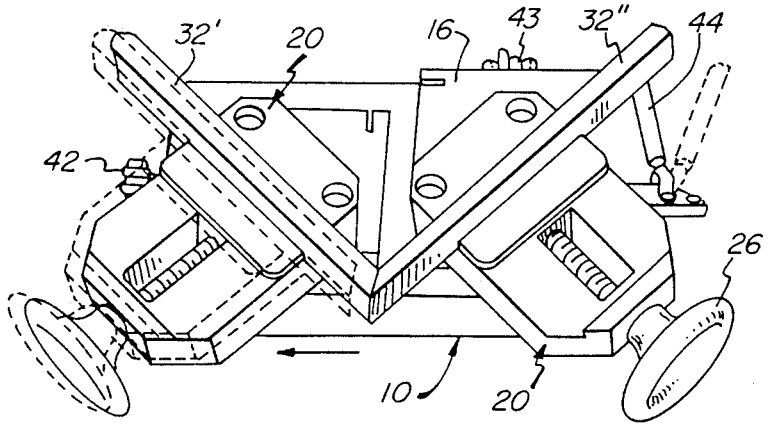

As suggested by the arrows in FIG. 3, one of the pieces of moulding 32' is initially brought into a position with its bevelled end face in close abutment (from an initial approximate position illustrated in phantom line) with the correspondingly bevelled complementary end of the other piece 32'', by operation of the control knob 42 to effect lateral movement of the plate 18. Then the pieces 32 are brought to a position of exact alignment by sliding them along the joint, through operation of the screw 43, thereby effecting movement of the plate 16 in a transverse direction; here again, displacement from an original approximate position (shown in phantom line) is involved (as may be appreciated, the alignment in this sense shown in full line in FIG. 3 would not normally occur at the phase of the procedure depicted therein).

The two components 32', 32'' are then separated (by movement in the direction indicated by the arrow in FIG. 5) to the phantom line position thereof, by operation of the lever handle 44 (being moved to its phantom line position). As noted above, this enables the application of glue to the surfaces to be joined, the tightly abutted relationship between which can thereafter readily be reestablished, quickly and precisely, by returning the lever handle to its full line position.

Figure 6:
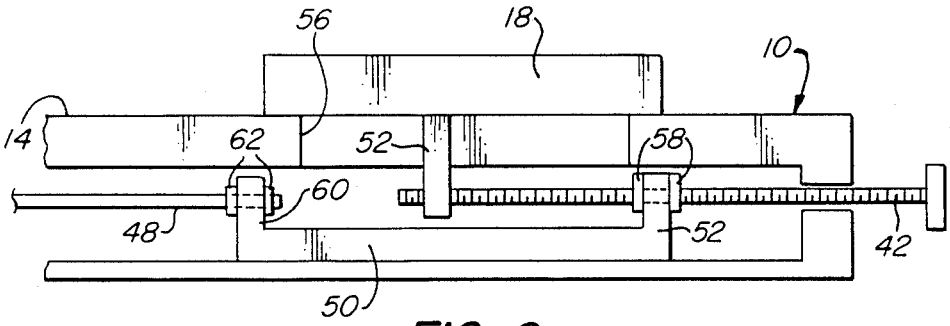
FIG. 6 is a schematic representation illustrating one form of mechanism that might be used for positioning of the laterally movable clamp assembly.

FIG. 6 diagrammatically illustrates a subassembly by which the screw 42 and the connecting rod 48 may be operatively attached to the plate 18 (the clamp assembly being omitted). As can be seen, a slider 50 is disposed within the body 10, and has a first upstanding portion 52 through which the screw 42 passes into threaded engagement with a lug 54 (hereinabove referred to as an element having a threaded opening), which depends from the plate 18 and passes through a slot 56 in the top wall of the body 10. The slider 50 is fixed at a given location along the length of the screw, by elements 58, so that turning of the screw 42 will change the position of the plate 18 relative to the slider.

At the opposite end, the slider 50 has a second upstanding portion 60, in which the end of the rod 48 is affixed by elements 62. Lateral movement of the rod 48 (by operation of the handle 44) will therefore shift the plate 18 without changing its position relative to the slider 50. Consequently, once a final position for the clamp assembly on the plate 18 has been achieved by adjustment of the screw 42, the plate may be displaced by operation of the quick-throw lever 44; it can thereafter be returned to its original position by reverse operation of the lever, without loss of exact alignment of the mounted frame pieces.

Figure 7:
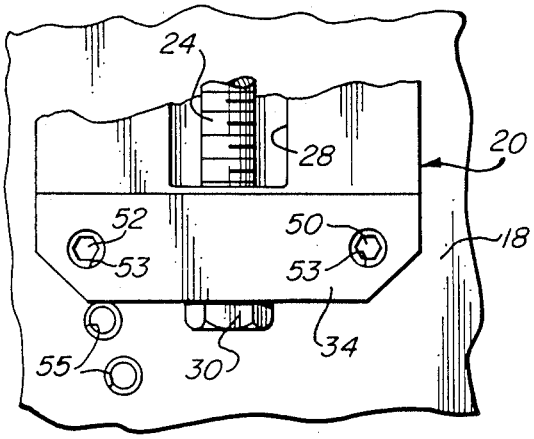
FIG. 7 is a fragmentary schematic plan view showing the means by which angular repositioning of one of the claim assemblies can be effected.

Each of the clamp bodies 20 is secured to its respective slide plate 16, 18 by a pivot screw 50 and a locating screw 52, which extend into the associated plate through bores 53 formed in the corners of the body. It will readily be appreciated that, by loosening of the locating screws 52 the bodies 20 can be rotated to achieve a different angular relationship, thereby enabling the frame components to be disposed at relative angles other than 90°. This feature enables construction of nonrectangular frames, such as may be made for example with six or eight sides. The slide plates 16 and 18 may, as seen in FIG. 7, be provided with tapped holes 55 (two of which are visible, and a third engaging the screw 52) at positions corresponding to the angular orientations of the clamping bodies required for making the most common frame shapes, so as to most readily permit those positions to be achieved.

Modifications of the vise of the invention can of course be made without departing from the scope of the instant claims. It may also incorporate features not specifically mentioned heretofore, such as resilient pads on the jaw surfaces, to yield slightly when the moulding pieces are squeezed together for precise fit, and to avoid marring. The base and support plates may be provided with guide marks for initial positioning of the clamp assemblies at locations that will ensure sufficient travel for convenient adjustment. Finally, it should be noted that the vise is so configured as to provide adequate clearance between the clamp assemblies for nailing of the frame components, if such construction is desired.

Thus, it can be seen that the present invention provides a novel vise that is particularly adapted for joining frame pieces, which is fast and convenient to use, which enables highly precise alignment of the frame components, and which is of relatively simple and inexpensive construction. The vise incorporates a mechanism for separating the frame components from one another, without need for removing and repositioning them in the clamp, so as to facilitate gluing operations, and it includes means for readily adjusting the angular attitude of the clamp assemblies so as to adapt the device for making frames having components disposed in non-perpendicular orientations. A novel method is also provided, whereby the frame components can be brought to an initial precise relationship, separated, and thereafter returned to the original position following, for example, the application of a fast-setting adhesive to the surfaces at which the joint will ultimately be formed.

Having thus described the invention, what is claimed is:

1. A vise for joining frame pieces having complementary end faces, comprising:

a base having an upper surface;

a first clamp assembly including a first plate slidably mounted on said base upper surface, said first plate and said base having cooperating means for constraining said first plate to movement laterally with respect to said base along a path on a first rectilinear axis and in a single plane, and a first body supported on said first plate and having means for clamping a frame piece thereon;

a second clamp assembly including a second plate slidably mounted on said base upper surface, said second plate and said base having cooperating means for constraining said second plate to movement transversely with respect to said base along a path on a second rectilinear axis perpendicular to said first axis and in a single plane, and a second body supported on said second plate laterally adjacent said first body, said second body having means for clamping a frame piece thereon to dispose it in a common plane with a frame piece clamped on said first body;

first screw means operatively connected to said first plate for finely adjusting the position of said first clamp assembly along said path on said first axis, and for fixing it thereat; and second screw means operatively connected to said second plate for finely adjusting the position of said second clamp assembly along said path on said second axis, independently of the adjustment of said first clamp assembly by said first screw means, and for fixing it thereat, whereby frame pieces clamped on said bodies can be brought into and maintained in mutual contact in at least one accurate angular relationship to one another.

2. The vise of claim 1 wherein said bodies and said plates have cooperating means thereon for varying the angular orientation of said body relative to the associated plate, about a normal axis therebetween, thereby permitting such contact of frame pieces in a each of a plurality of angular relationships to one another.

3. The vise of claim 1 additionally including a mechanism for laterally shifting said first plate between predetermined limit positions on said first axis, said mechanism operating independently of said screw means of said first clamp assembly to quickly move said first plate between said limit positions.

4. The vise of claim 3 wherein said shifting mechanism comprises a lever.

5. The vise of claim 1 wherein said base has a flat upper surface.

6. The vise of claim 4 wherein said shifting mechanism comprises a lever.

7. A vise for joining frame pieces having complementary end faces, comprising:

a base having an upper surface;

a first clamp assembly including a first plate slidably mounted on said base upper surface, said first plate and said base having cooperating means for constraining said first plate to movement laterally with respect to said base along a path on a first rectilinear axis and in a single plane, and a first body supported on said first plate and having means for clamping a frame piece thereon;

a second clamp assembly including a second plate slidably mounted on said base upper surface, said second plate and said base having cooperating means for constraining said second plate to movement transversely with respect to said base along a path on a second rectilinear axis perpendicular to said first axis and in a single plane, and a second body supported on said second plate laterally adjacent said first body, said second body having means for clamping a frame piece thereon to dispose it in a common plane with a frame piece clamped on said first body;

first means operatively connected to said first plate for finely adjusting the position of said first clamp assembly along said path on said first axis, and for fixing it thereat;

second means operatively connected to said second plate for finely adjusting the position of said second clamp assembly along said path on said second axis, independently of the adjustment of said first clamp assembly by said first screw means, and for fixing it thereat; and a mechanism for laterally shifting said first plate between predetermined limit positions on said first axis, said mechanism including means to quickly move said plate from one of said limit positions to the other, and operating independently of said first means for finely adjusting the position of said first clamp assembly, whereby frame pieces clamped on said bodies can be brought into and maintained in mutual contact in at least one accurate rate angular relationship to one another, and can quickly be separated by operation of said mechanism.

8. The vise of claim 7 wherein said bodies and said plates have cooperating means thereon for varying the angular orientation of said body relative to the associated plate, about a normal axis therebetween, thereby permitting such contact of frame pieces in a each of a plurality of angular relationships to one another.

9. The vise of claim 8 wherein said base has a flat upper surface.

10. A vise for joining frame pieces having complementary end faces, comprising:

a base having an upper surface;

a first clamp assembly including a first plate slidably mounted on said base upper surface, said first plate and said base having cooperating means for constraining said first plate to movement laterally with respect to said base along a path on a first rectilinear axis and in a single plane, and a first body supported on said first plate and having means for clamping a frame piece thereon;

a second clamp assembly including a second plate slidably mounted on said base upper surface, said second plate and said base having cooperating means for constraining said second plate to movement transversely with respect to said base along a path on a second rectilinear axis perpendicular to said first axis and in a single plane, and a second body supported on said second plate laterally adjacent said first body, said second body having means for clamping a frame piece thereon to dispose it in a common plane with a frame piece clamped on said first body;

first screw means operatively connected to said first plate for finely adjusting the position of said first clamp assembly along said path on said first axis, and for fixing it thereat;

second screw means operatively connected to said second plate for finely adjusting the position of said second clamp assembly along said path on said second axis, independently of the adjustment of said first clamp assembly by said first screw means, and for fixing it thereat; and cooperating means on said bodies and said plates for varying the angular orientation of said body relative to the associated plate, about a normal axis therebetween, and for affixing both of said bodies in each of a plurality of the same predetermined angular orientations thereon, thereby permitting such contact of frame pieces in a each of a plurality of angular relationships to one another, whereby frame pieces clamped on said bodies can be brought into and maintained in mutual contact in a plurality of accurate angular relationships to one another.

* * * * *